US009844250B1

(12) United States Patent
Wu et al.

(10) Patent No.: US 9,844,250 B1
(45) Date of Patent: Dec. 19, 2017

(54) ANTI-TURNING UMBRELLA FRAME

(71) Applicant: Tsun-Zong Wu, New Taipei (TW)

(72) Inventors: Tsun-Zong Wu, New Taipei (TW); Hsien-Jung Chen, New Taipei (TW)

(73) Assignee: Tsun-Zong Wu, New Taipei (TW)

( * ) Notice: Subject to any disclaimer, the term of this patent is extended or adjusted under 35 U.S.C. 154(b) by 0 days.

(21) Appl. No.: 15/449,413

(22) Filed: Mar. 3, 2017

(51) Int. Cl.

| | |
|---|---|
| ***A45B 25/02*** | (2006.01) |
| ***A45B 19/10*** | (2006.01) |
| ***A45B 25/22*** | (2006.01) |
| ***A45B 25/14*** | (2006.01) |
| ***A45B 25/16*** | (2006.01) |
| ***A45B 25/00*** | (2006.01) |

(52) U.S. Cl.
CPC ..... *A45B 25/02* (2013.01); *A45B 19/10* (2013.01); *A45B 25/006* (2013.01); *A45B 25/143* (2013.01); *A45B 25/16* (2013.01); *A45B 25/22* (2013.01)

(58) Field of Classification Search
CPC ..... A45B 25/02; A45B 25/22; A45B 25/16; A45B 25/006; A45B 25/143; A45B 19/00; A45B 19/10
USPC ..... 135/22, 25.1, 25.3–25.32, 29–32
See application file for complete search history.

(56) References Cited

U.S. PATENT DOCUMENTS

| | | | | | |
|---|---|---|---|---|---|
| 2,616,439 | A * | 11/1952 | Thompson | A45B 19/10 | 135/25.31 |
| 3,902,514 | A * | 9/1975 | Weber | A45B 19/10 | 135/25.3 |
| 4,105,039 | A * | 8/1978 | Schultes | A45B 19/10 | 135/25.33 |
| 4,658,844 | A * | 4/1987 | Ping | A45B 19/10 | 135/25.3 |
| 5,390,686 | A * | 2/1995 | Lin | A45B 25/143 | 135/20.3 |
| 6,758,228 | B1 * | 7/2004 | You | A45B 19/10 | 135/25.31 |
| 9,301,582 | B2 * | 4/2016 | Haythornthwaite | A45B 25/22 | |
| 2003/0098049 | A1 * | 5/2003 | Huang | A45B 19/10 | 135/29 |
| 2006/0144432 | A1 * | 7/2006 | Wu | A45B 19/10 | 135/25.3 |
| 2007/0017562 | A1 * | 1/2007 | Ko | A45B 19/10 | 135/25.3 |
| 2007/0204894 | A1 * | 9/2007 | Huang | A45B 19/10 | 135/31 |

* cited by examiner

*Primary Examiner* — Winnie Yip
(74) *Attorney, Agent, or Firm* — Muncy, Geissler, Olds & Lowe, P.C.

(57) ABSTRACT

An anti-turning umbrella frame is revealed. The anti-turning umbrella frame includes a plurality of inner main ribs, a plurality of inner connecting ribs, a plurality of middle main ribs, and a plurality of stretchers. An outer end of the inner main rib is riveted to an inner end of the middle main rib to form a first rivet point. The anti-turning umbrella frame features on that a positioning portion is disposed on an inner side of the first rivet point of the inner main rib while a locking portion corresponding to the positioning portion is arranged at or close to the outer end of the inner connecting rib. The locking portion is locked with the positioning portion while the umbrella frame is opened. Thereby the inner main rib and the middle main rib are connected to form a rigid body for preventing the middle main rib from turning over.

10 Claims, 11 Drawing Sheets

ANTI-TURNING UMBRELLA FRAME

BACKGROUND OF THE INVENTION

The present invention relates to a foldable umbrella, especially to an anti-turning umbrella frame of the foldable umbrella.

An umbrella designed to protect users against rain or sunlight has become one of our daily essentials. Especially foldable umbrellas with features of easy carrying and integral in storage such as automatic open/close umbrellas, automatic open umbrellas, automatic close umbrellas, manual umbrellas, etc. have become quite popular these days. A foldable umbrella generally includes a handle, a cap, a shaft, a notch, a runner, inner main ribs, middle main ribs, stretchers, inner connecting ribs, outer ribs, tips and cloth. Refer to FIG. 15, the main components of the umbrella include inner main ribs 1, inner connecting ribs 2, middle main ribs 3, and stretchers 4. An inner end of the inner main rib 1 is connected to a notch disposed on a shaft while an outer end of the inner main rib 1 is riveted to an inner end of the middle main rib 3. An inner end of the stretcher 4 is connected to a runner arranged at the shaft while an outer end of the stretcher 4 is riveted to a middle part of the inner main rib 1. The inner connecting rib 2 is set between a part of the stretcher 4 close to the outer end of the stretcher 4 and an inner end of the middle main rib 3. An inner end of the inner connecting rib 2 is riveted to the part of the stretcher 4 close to the outer end of the stretcher 4 while the outer end of the inner connecting rib 2 is riveted to the inner end of the middle main rib 3.

As the arrow C in FIG. 15 indicates, ribs of the umbrella are easy to be pulled upwards and turned inside out in sudden wind gusts. Refer to the arrow B in FIG. 15A, the middle main rib 3 is turned upward with respect to the inner main rib 1 and unable to support the cloth for protecting users from heavy rain. At the same time, the umbrella frame is deformed and damaged easily. Thus the service life of the foldable umbrella is affected.

SUMMARY OF THE INVENTION

Therefore it is a primary object of the present invention to provide an anti-turning umbrella frame that includes a positioning portion disposed on an inner main rib and a corresponding locking portion arranged at or close to an outer end of an inner connecting rib. The locking portion and the positioning portion are locked with each other while opening the umbrella frame. Thus the inner main rib and a middle main rib are connected to form a rigid body for preventing the middle main rib from turning over.

In order to achieve the above object, an anti-turning umbrella frame of the present invention includes a plurality of inner main ribs, a plurality of inner connecting ribs, a plurality of middle main ribs, and a plurality of stretchers. An inner end of the inner main rib is connected to a notch on a shaft while an outer end of the inner main rib is riveted to an inner end of the middle main rib to form a first rivet point. An inner end of the stretcher is connected to a runner at the shaft while an outer end of the stretcher is riveted to a middle part of the inner main rib to form a second rivet point. The inner connecting rib is arranged between a part of the stretcher close to the outer end and an inner end of the middle main rib. An inner end of the inner connecting rib is riveted to the part of the stretcher close to the outer end to form a third rivet point while the outer end of the inner connecting rib is riveted to the inner end of the middle main rib to form a fourth rivet point. The fourth rivet point is located on an inner side of the first rivet point when the umbrella frame is opened. The anti-turning umbrella frame according to the present invention features on that a positioning portion is disposed on an inner side of the first rivet point of the inner main rib while a locking portion is arranged at the inner connecting rib. The locking portion is corresponding to and matched with the positioning portion. The locking portion and the positioning portion are locked with each other synchronously while the umbrella frame is opened. Thus the inner main rib and the middle main rib are connected to form a rigid body for preventing the fourth rivet point from rotating around or pivoting downward with respect to the first rivet point (as the arrow B in FIG. 15A indicates). Thereby the middle main rib will not be turned over with respect to the inner main rib. The anti-turning umbrella frame has the advantages of simple structure, convenient manufacturing, safe use, longer service life and anti-turning effect.

The locking portion is set on an outer end of the inner connecting rib.

The locking portion is set at the position close to an outer end of the inner connecting rib.

The inner connecting rib can be an integrated part made from one plate, formed by two plates attached to each other at two ends thereof with a gap at a middle part therebetween, integrally formed by one round rod, or formed by two plates attached to each other at two ends thereof with a gap at a middle part therebetween and one plate connected to an outer end of the two plates.

The positioning portion is located on an inner side of the first rivet point and there is a certain distance between the positioning portion and the first rivet point that connects the middle main rib and the inner main rib.

The cross section of the positioning portion can be round, oval or oblong. The positioning portion can be a cylinder, an elliptic cylinder, or oblong cylinder.

An oblong rivet hole is arranged at the fourth rivet point that the inner connecting rib and the middle main rib are riveted. Through the oblong rivet hole, the inner connecting rib can be self-adjusted while the umbrella frame being opened or closed to ensure that the locking portion is mounted into and locked with the positioning portion. The connection of the umbrella frame is more stable.

The oblong rivet hole is located on an outer side of the locking portion. The arrangement of the oblong rivet hole ensures that the locking portion is hooked with the positioning portion so that the stability of the umbrella frame is ensured.

A return spring is set on the positioning portion. Thus the positioning portion can be adjusted elastically relative to the locking portion while being locked with the locking portion. Thereby the reliability in opening and closing of the umbrella is increased.

A closing spring is set between the inner main rib and the inner connecting rib while the inner main rib is disposed with a spring rod. The spring rod is set on the inner side of the positioning portion and the inner connecting rib is arranged with a spring hook. There is a certain distance between the spring hook and the inner end of the inner connecting rib. One end of the closing spring is hooked on the spring hook while the other end thereof is hooked on the spring rod. The umbrella is collapsed and closed quickly under action of the closing spring during closing of the umbrella.

The outer end of the middle main rib is riveted to the rib joint and the rib joint is connected to the outer rib.

A middle connecting rib is disposed between the rear end of the inner main rib and the rib joint. A middle part of the middle main rib is set with a stopping rod used for leaning against the middle connecting rib. One end of the middle connecting rib is connected to the inner connecting rib by a hook while the other end thereof is passed through the space between the stopping rod and the middle main rib to connect to and rotate with the inner end of the rib joint.

The foldable umbrella includes an automatic open/close umbrella, an automatic open umbrella, an automatic close umbrella, and a manual umbrella.

The anti-turning umbrella frame of the present invention has the following advantages:

1. The anti-turning umbrella frame features on simple structure, convenient manufacturing, and the positioning portion disposed on the inner main rib and corresponding to the locking portion arranged at the outer end or close to the outer end of the inner connecting rib. The umbrella frame provides anti-turning effect without increasing the manufacturing cost.

2. The anti-turning umbrella frame is safe in use. During extension of the locking portion of the inner connecting rib is gradually mounted into the positioning portion of the inner main rib. The inner main rib and the middle main rib are connected to form a rigid body owing to the locking portion locked with the positioning portion during a sudden wind gust that turns the umbrella inside out. Thus the umbrella frame provides the anti-turning and users feel safe while using the umbrella.

3. The disposition of the oblong rivet hole on the inner connecting rib enables the inner connecting rib can be self-adjusted during opening and closing of the umbrella frame. This ensures the locking portion to be mounted into and locked with the positioning portion. Thus the stability of the umbrella frame is ensured.

DETAILED DESCRIPTION OF THE PREFERRED EMBODIMENTS

Refer from FIG. 1 to FIG. 11, an embodiment of an anti-turning umbrella frame is revealed. A locking portion 8 is disposed on an outer end of the inner connecting rib 2. The anti-turning umbrella frame of the present invention is applied to an automatic open/close umbrella, an automatic open umbrella, an automatic close umbrella, and a manual umbrella. In the following embodiments, the inner side/end means the side/end close to the shaft of the umbrella while the outer side/end means the side/end opposite to the inner side, away from the shaft of the umbrella.

Figures 4, 4A:
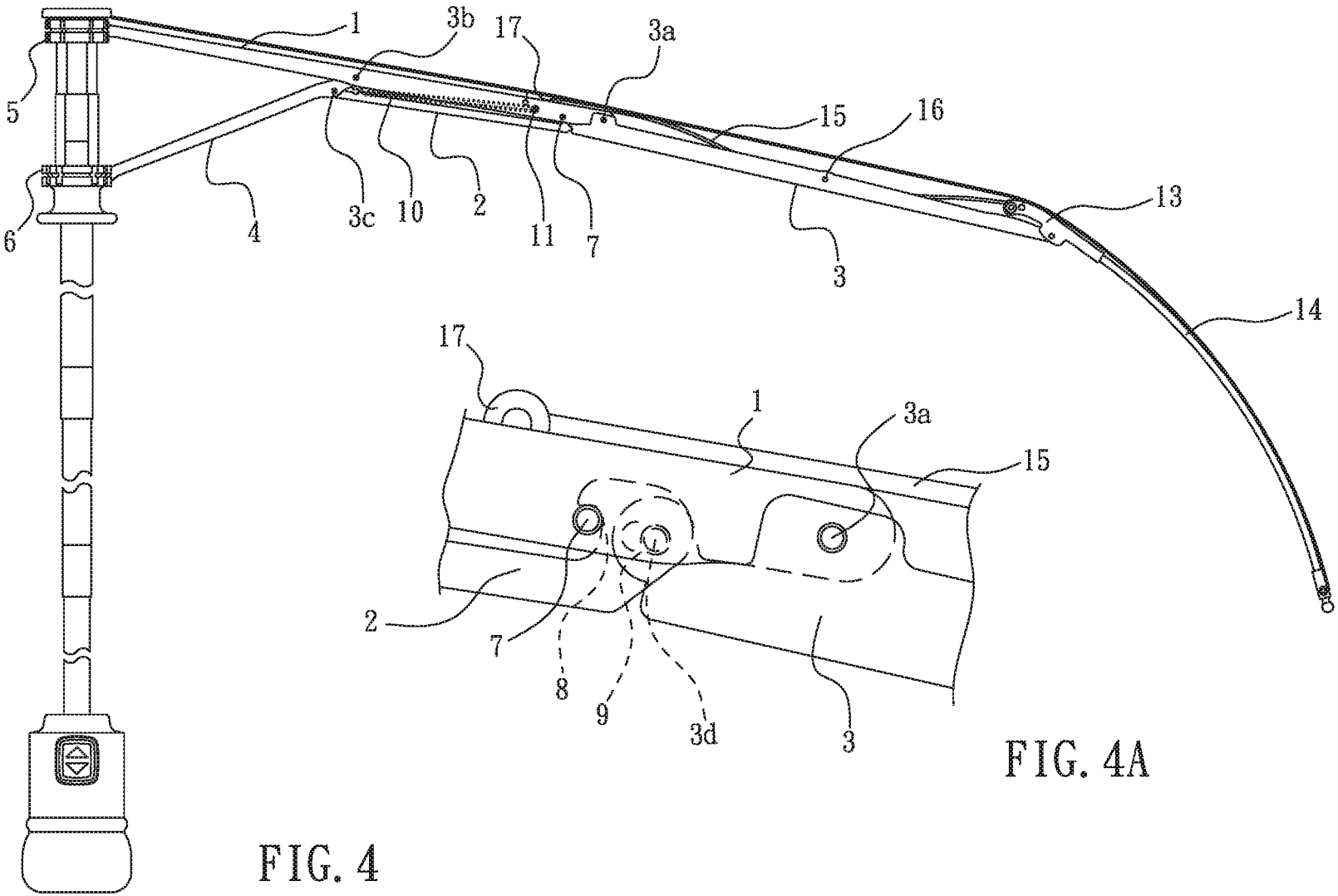
FIG. 4 is a schematic drawing showing an opened embodiment applied to an automatic open/close umbrella according to the present invention.
FIG. 4A is a partial enlarged view of the embodiment in FIG. 4 according to the present invention.
Figure 5:
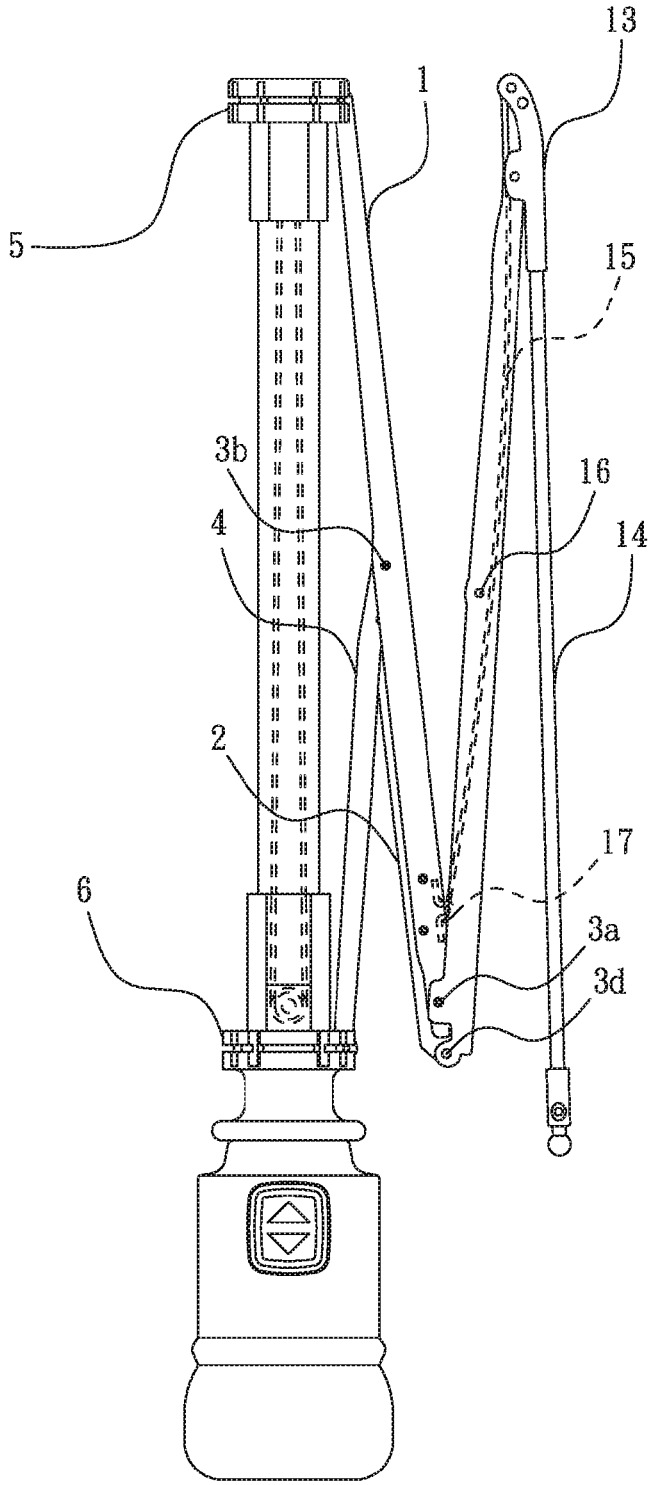
FIG. 5 is a schematic drawing showing the embodiment in FIG. 4 in a closed state according to the present invention.
Figure 6:
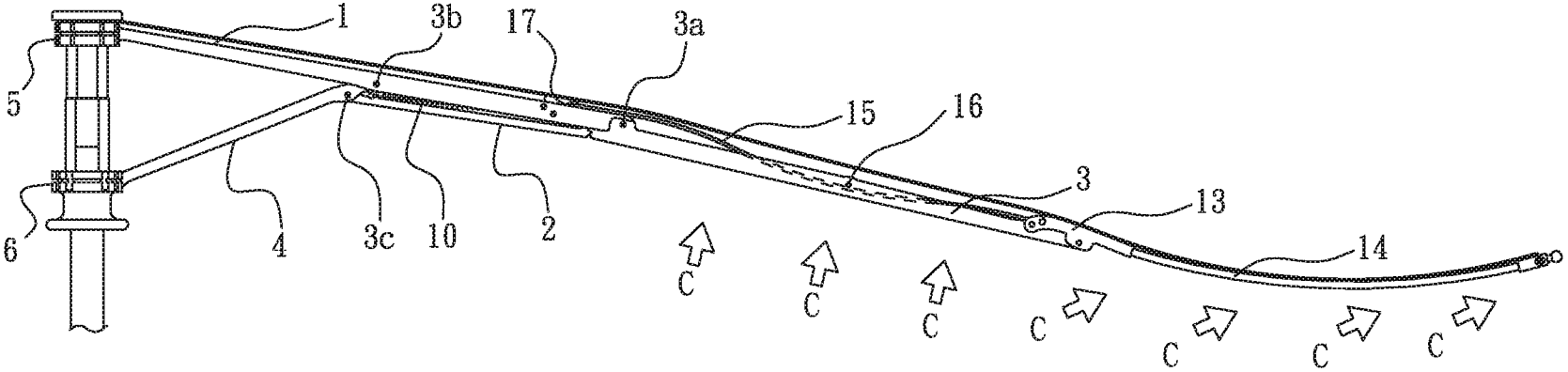
FIG. 6 is a schematic drawing showing the embodiment in FIG. 4 in a sudden wind gust according to the present invention.
Figure 6A:
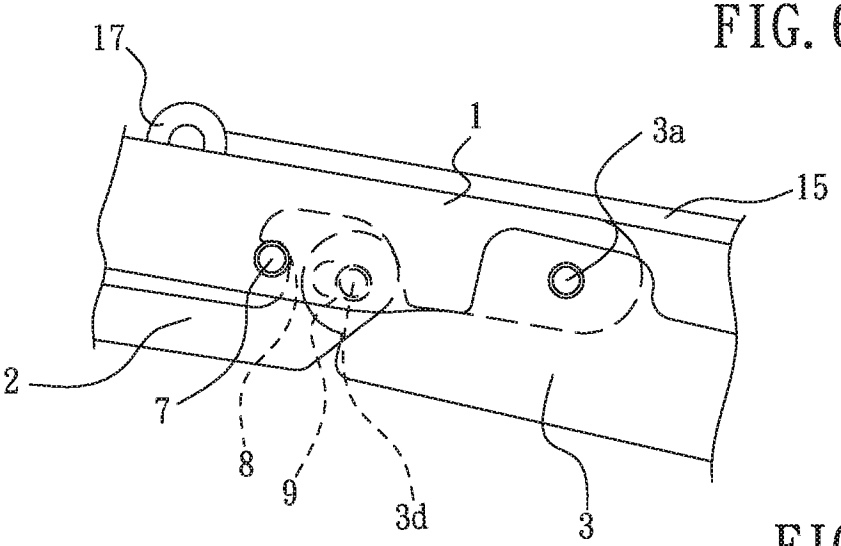
FIG. 6A is a partial enlarged view of the embodiment in FIG. 6 according to the present invention.
Figure 7:
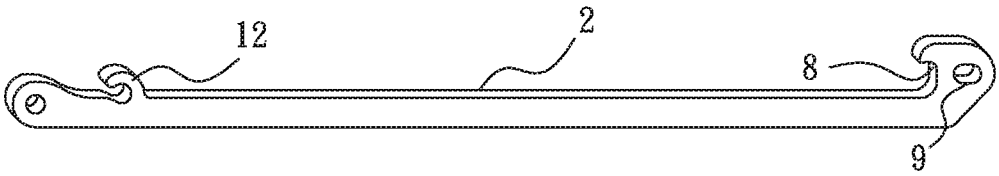
FIG. 7-10 are schematic drawings showing various structures of an inner connecting rib according to the present invention.
Figure 8:
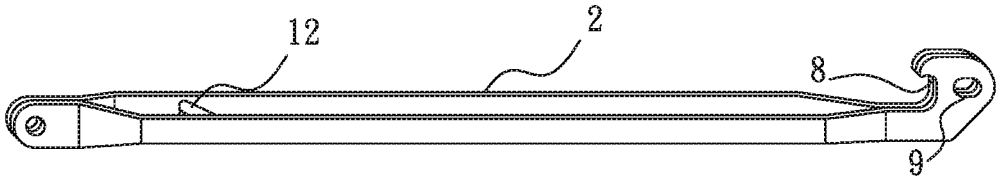

Refer to FIG. 4, FIG. 5 and FIG. 6, an anti-turning umbrella frame according to the present invention includes a plurality of inner main ribs 1, a plurality of inner connecting ribs 2, a plurality of middle main ribs 3, and a plurality of stretchers 4. An inner end of the inner main rib 1 is connected to a notch 5 disposed on a shaft while an outer end of the inner main rib 1 is riveted to an inner end of the middle main rib 3 to form a first rivet point 3*a*. An inner end of the stretcher 4 is connected to a runner 6 arranged at the shaft while an outer end of the stretcher 4 is riveted to a middle part of the inner main rib 1 to form a second rivet point 3*b*. The inner connecting rib 2 is arranged between a part of the stretcher 4 close to the outer end and an inner end of the middle main rib 3. An inner end of the inner connecting rib 2 is riveted to the part of the stretcher 4 close to the outer end to form a third rivet point 3*c* while the outer end of the inner connecting rib 2 is riveted to the inner end of the middle main rib 3 to form a fourth rivet point 3*d*. The fourth rivet point 3*d* is located on an inner side of the first rivet point 3*a* when the umbrella frame is opened.

The anti-turning umbrella frame according to the present invention features on that the inner main rib 1 is disposed with a positioning portion 7 that is located on an inner side of the first rivet point 3*a* thereof. The inner connecting rib 2 is arranged with a locking portion 8 that is corresponding to and matched with the positioning portion 7. The locking portion 8 is locked with the positioning portion 7 synchronously while the umbrella frame is opened. Thus the inner main rib 1 and the middle main rib 3 are connected to form a rigid body for preventing the fourth rivet point 3*d* from rotating around or pivoting downward with respect to the first rivet point 3*a*. Thereby the middle main rib 3 will not be turned over with respect to the inner main rib 1.

Figures 1, 1A:
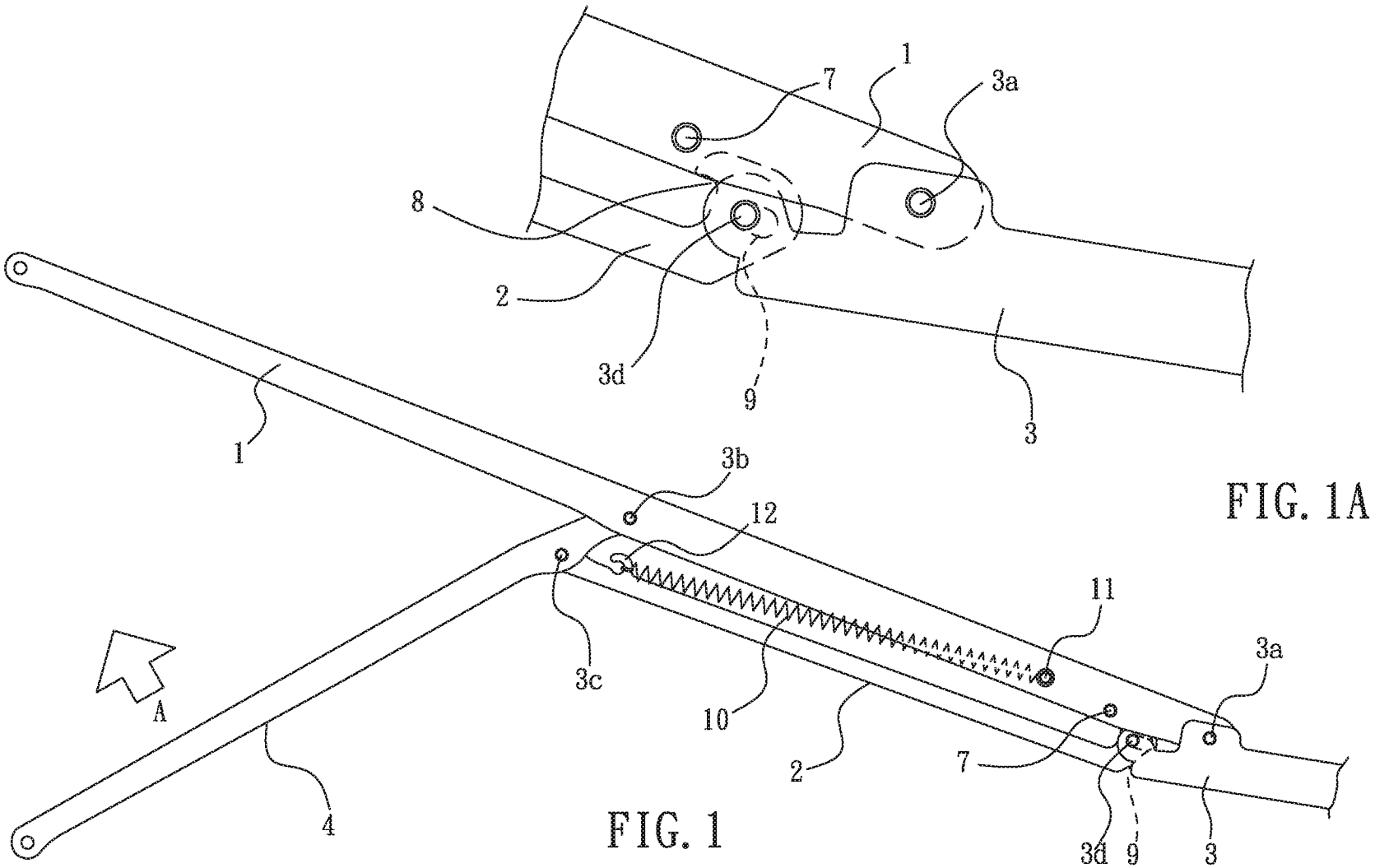
FIG. 1 is a schematic drawing showing a locking portion of an inner connecting rib going to be mounted into a positioning portion of an inner main rib of an embodiment according to the present invention.
FIG. 1A is a partial enlarged view of the embodiment in FIG. 1 according to the present invention.
Figure 2A:
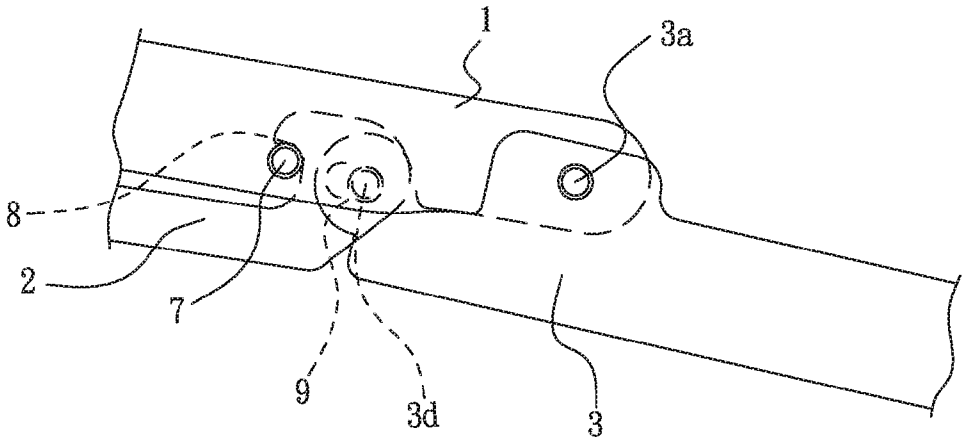
FIG. 2A is a partial enlarged view of the embodiment in FIG. 2 according to the present invention.
Figure 2:
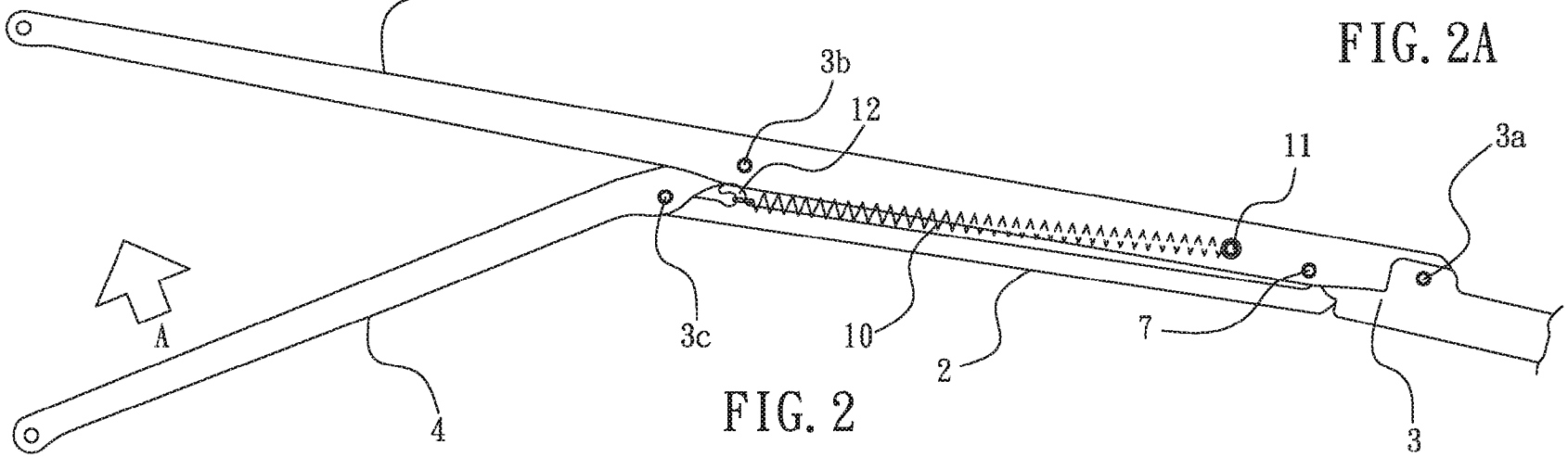
FIG. 2 is a schematic drawing showing the locking portion of the inner connecting rib mounted into the positioning portion to connect an inner main rib and a middle main rib and form a rigid body of the embodiment in FIG. 1 according to the present invention.

In the above embodiment, the positioning portion 7 is disposed on the inner side of the first rivet point 3*a* of the inner main rib 1 while the locking portion 8 corresponding to the positioning portion 7 is arranged at the outer end of the inner connecting rib 2. During extension of the umbrella frame, the locking portion 8 is locked with the positioning portion 7 synchronously. For example, the stretcher 4 is extended upward, as the arrow A in FIG. 1 and FIG. 2 indicates. The locking portion 8 of the inner connecting rib 2 is gradually mounted into the positioning portion 7 of the inner main rib 1, as shown in FIG. 1 and FIG. 1A. Finally, the locking portion 8 is locked with the positioning portion 7 when the umbrella frame has been opened, as shown in FIG. 2 and FIG. 2A. As the arrow C in FIG. 6 indicates, the inner main rib 1 and the middle main rib 3 are connected to form a rigid body owing to the locking portion 8 already locked with the positioning portion 7 during a sudden wind gust that turns the umbrella inside out. Thus the middle main rib 3 will not be turned relative to the inner main rib 1. At the moment, the wind gust is introduced along a rib joint 13 and an outer rib 14 to move out, as the arrow C in FIG. 6 indicates. Thus the umbrella can still be used for protection from rain, without being affected by the wind gust. Moreover, the positioning portion 7 is located on an inner side of the first rivet point 3*a* and there is a certain distance between the positioning portion 7 and the first rivet point 3*a* that connects the middle main rib 3 and the inner main rib 1. Thus a stronger leverage is given to the first rivet point 3*a* to increase a reaction force of the middle main rib 3 being turned over after the locking portion 8 being locked with the positioning portion 7. Thus the leverage further prevents the middle main rib 3 from being turned over.

Figure 9:
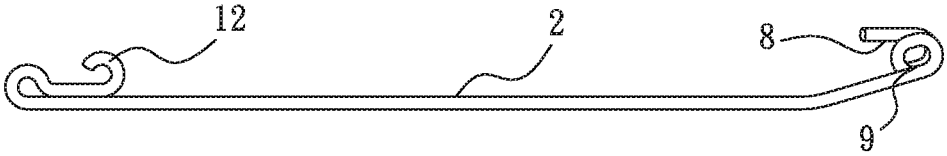
Figure 10:
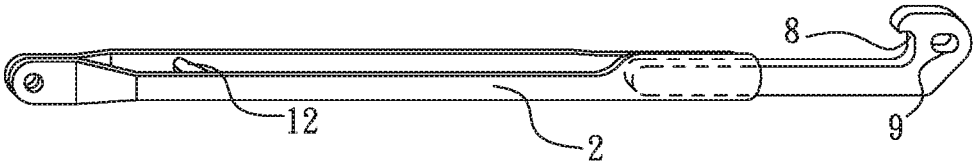

The structure of the inner connecting rib 2 is not limited. For example, the inner connecting rib 2 can be an integrated part made from one plate, as shown FIG. 7. Or refer to FIG. 8, the inner connecting rib 2 can be formed by two plates attached to each other at two ends thereof with a gap at a middle part therebetween. Or the inner connecting rib 2 can be integrally formed by one round rod, as shown in FIG. 9. Refer to FIG. 10, the inner connecting rib 2 can also be formed by two plates attached to each other at two ends thereof with a gap at a middle part therebetween and having one plate connected to an outer end of the two plates. The variety of the umbrella frame structure/manufacturing is increased.

Moreover, an oblong rivet hole 9 is arranged at the position the inner connecting rib 2 riveted to the inner end of the middle main rib 3 (the fourth rivet point 3*d* of the inner connecting rib 2), as shown in FIG. 1A, FIG. 2A and FIG. 7-10. The oblong rivet hole 9 on the inner connecting rib 2 is located on an outer side of the locking portion 8. Through the oblong rivet hole 9, the inner connecting rib 2 can be moved outward and inward relative to the fourth rivet point 3*d* for self-adjustment while the umbrella frame being opened or closed. This ensures that the locking portion 8 is gradually mounted into and locked with the positioning portion 7. The firm connection of the umbrella frame prevents the umbrella frame from turning over while being opened. The arrangement of the oblong rivet hole 9 also provides flexibility of the position the inner connecting rib 2 riveted to the inner end of the middle main rib 3 (the fourth rivet point 3*d*) so that the force the fourth rivet point 3*d* taken is reduced and the service life of the foldable umbrella is extended greatly.

Figure 11:
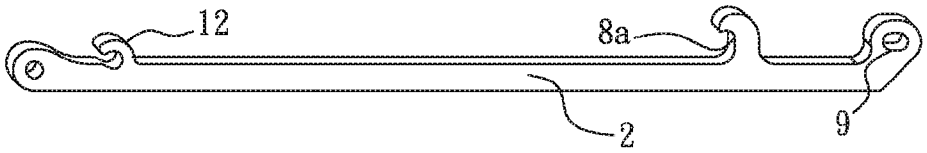
FIG. 11 is another embodiment in which a locking portion is disposed on the position close to an outer end of an inner connecting rib according to the present invention.
Figure 12:
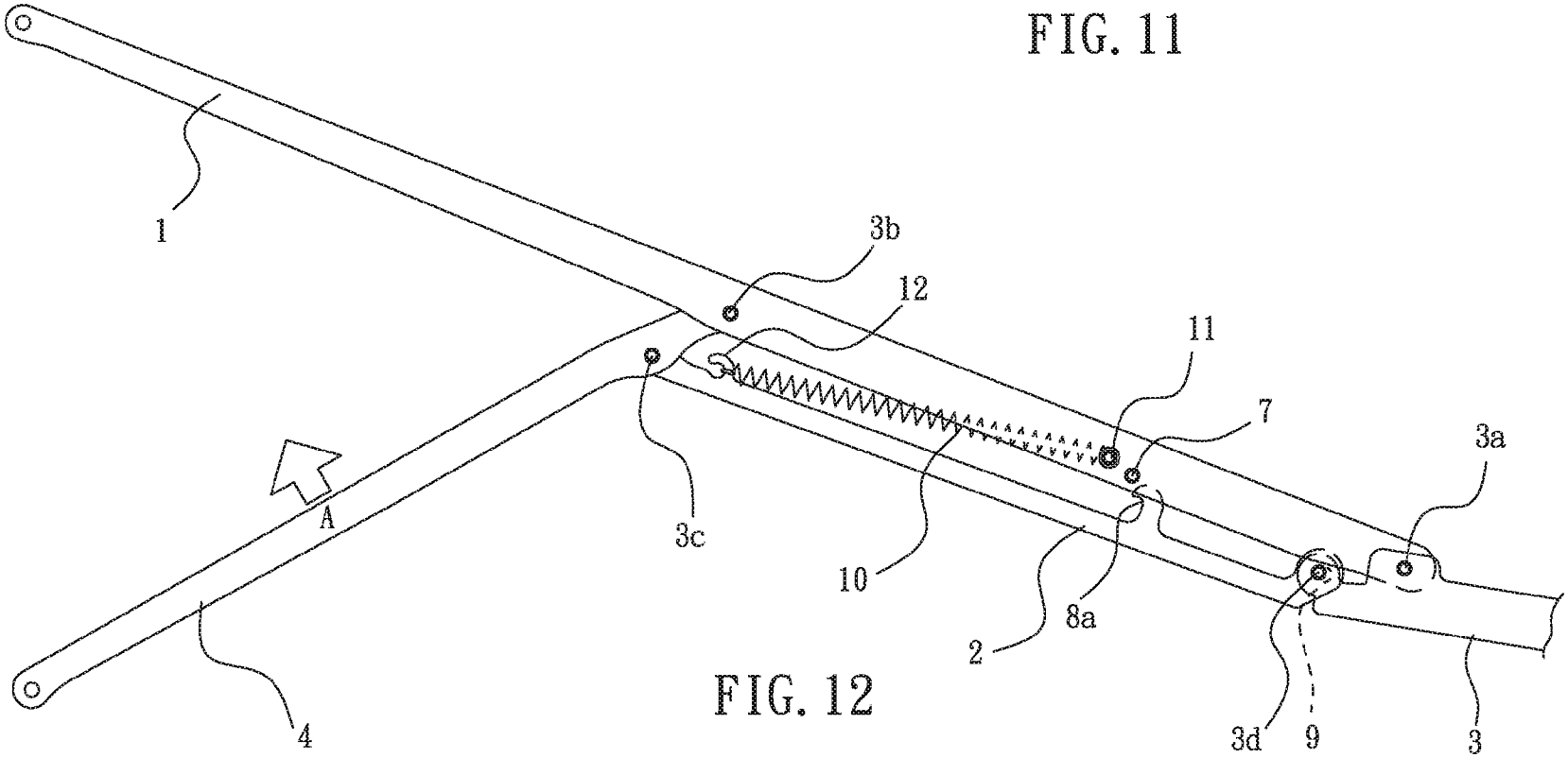
FIG. 12 is a schematic drawing showing a locking portion of an inner connecting rib going to be mounted into a positioning portion of an inner main rib of the embodiment in FIG. 11 according to the present invention.
Figure 13:
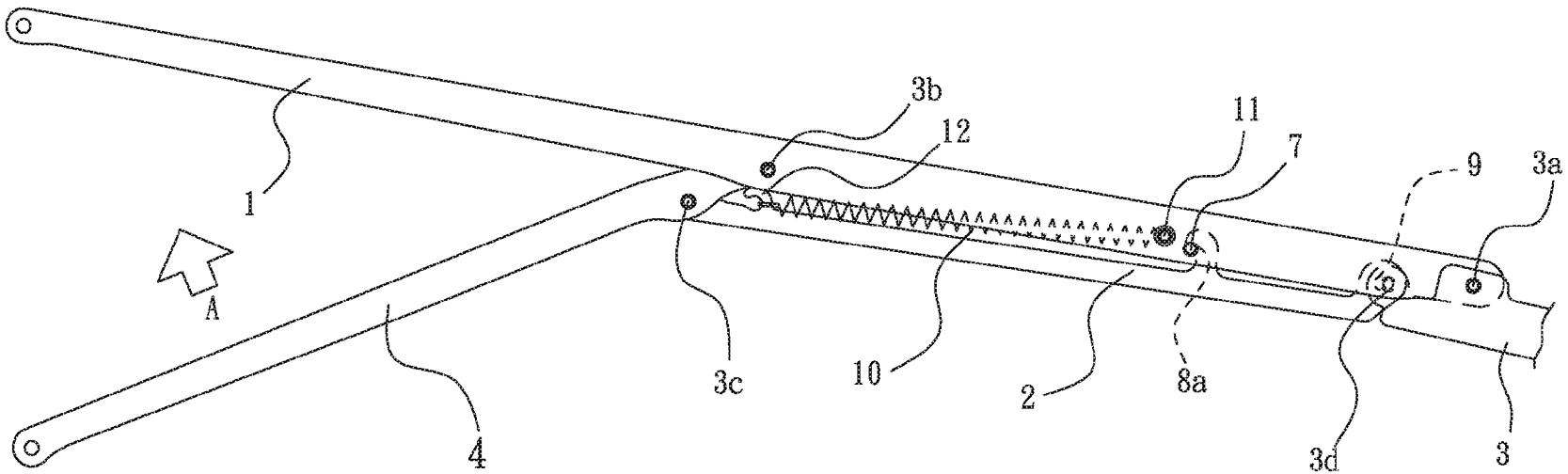
FIG. 13 is a schematic drawing showing the locking portion of the inner connecting rib mounted into the positioning portion to connect an inner main rib and a middle main rib and form a rigid body of the embodiment in FIG. 12 according to the present invention.

Refer to FIG. 11, FIG. 12 and FIG. 13, another embodiment of the present invention is revealed. The difference between this embodiment and the above one is in that the locking portion 8 is disposed on the position close to the outer end of the inner connecting rib 2, as shown in FIG. 11. There is a certain distance between the locking portion 8 and the outer end of the inner connecting rib 2 (the position of the fourth rivet point 3*d* or the position of the oblong rivet hole 9). In this embodiment, there is also a certain distance between the positioning portion 7 on the inner side of the first rivet point 3*a* of the inner main rib 1 and the outer end of the inner main rib 1 (first rivet point 3*a*). Thus the locking portion 8 can be locked with the positioning portion 7 synchronously while the umbrella frame being opened. For example, the locking portion 8 of the inner connecting rib 2 is going or gradually to be mounted into the positioning portion 7 of the inner main rib 1 during opening of the umbrella frame, as shown in FIG. 12. Then the locking portion 8 is already locked with the positioning portion 7 after the umbrella frame being opened completely, as shown in FIG. 13. In case of a sudden wind gust, as the arrow C in FIG. 6 indicates, the umbrella frame will not be tuned over because the positioning portion 7 and the locking portion 8 have already been locked with each other. Thus the umbrella will not be easily turned inside out.

Furthermore, the cross section of the positioning portion 7 can be round, oval or oblong. The positioning portion 7 can be formed by the rivet, but not limited. The positioning portion 7 can also be a hook formed on the inner main rib 1 by machining (not shown in figures). The locking portion 8 can be a positioning hook or a positioning slot able to be locked with the positioning portion 7 correspondingly.

Figure 3:
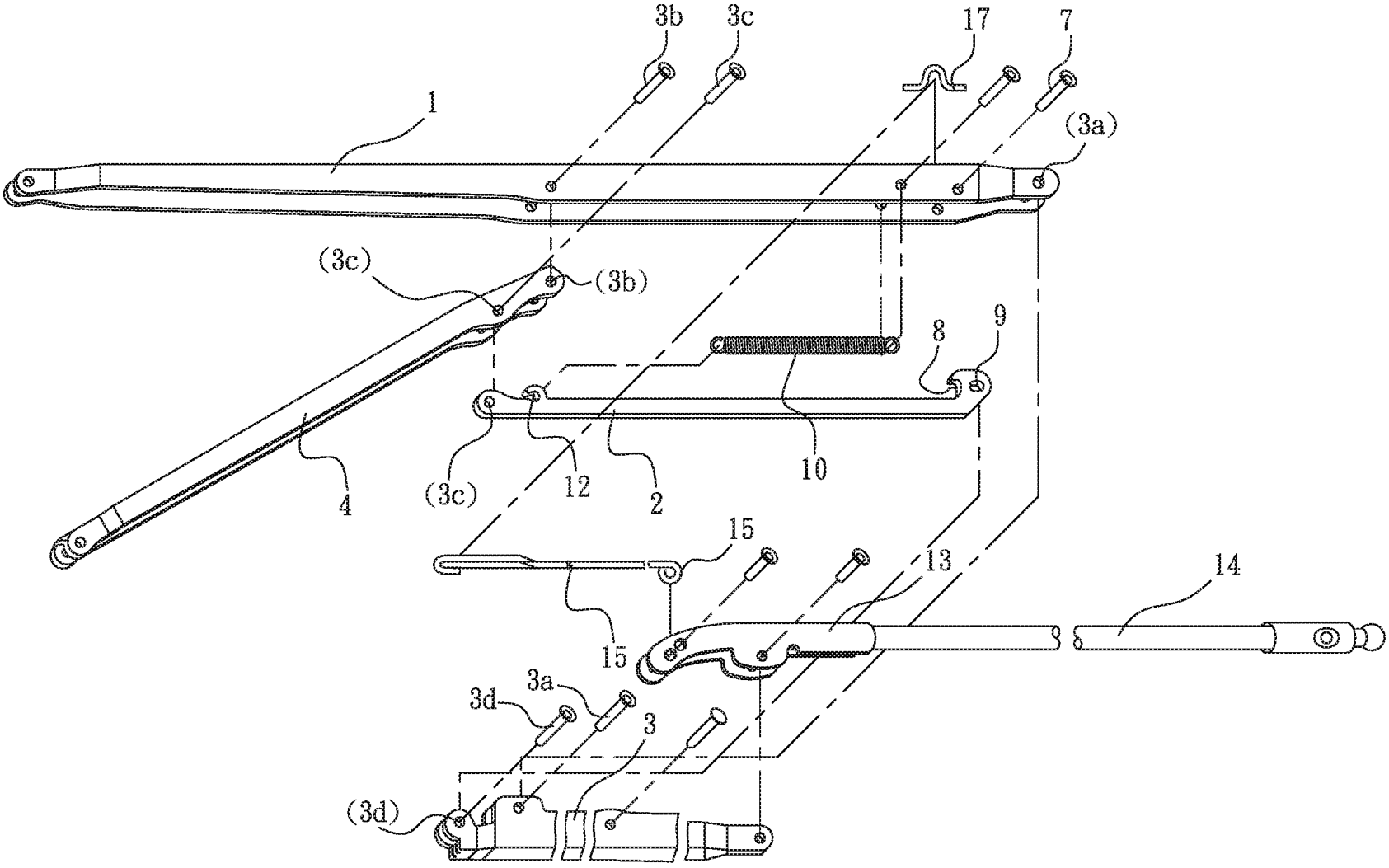
FIG. 3 is an explosive view of an umbrella frame according to the present invention.

As shown in FIG. 3, FIG. 4 and FIG. 5, take an automatic open umbrella (or an automatic close umbrella) as an example, a closing spring 10 is set between the inner main rib 1 and the inner connecting rib 2 while the inner main rib 1 is disposed with a spring rod 11. The spring rod 11 is disposed on the inner side of the positioning portion 7 while the inner connecting rib 2 is arranged with a spring hook 12. There is a certain distance between the spring hook 12 and the inner end of the inner connecting rib 2. One end of the closing spring 10 is hooked on the spring hook 12 while the other end thereof is hooked on the spring rod 11. During closing of the umbrella, the umbrella is collapsed and closed quickly under action of the closing spring 10. The outer end of the middle main rib 3 is riveted to the rib joint 13 and the rib joint 13 is connected to the outer rib 14. A middle connecting rib 15 is disposed between the rear end of the inner main rib 1 and the rib joint 13. A middle part of the middle main rib 3 is set with a stopping rod 16 used for leaning against the middle connecting rib 15. One end of the middle connecting rib 15 is connected to the inner connecting rib 2 by a hook 17 while the other end thereof is passed through the space between the stopping rod 16 and the middle main rib 3 to connect to and rotate with the inner end of the rib joint 13.

Figure 14:
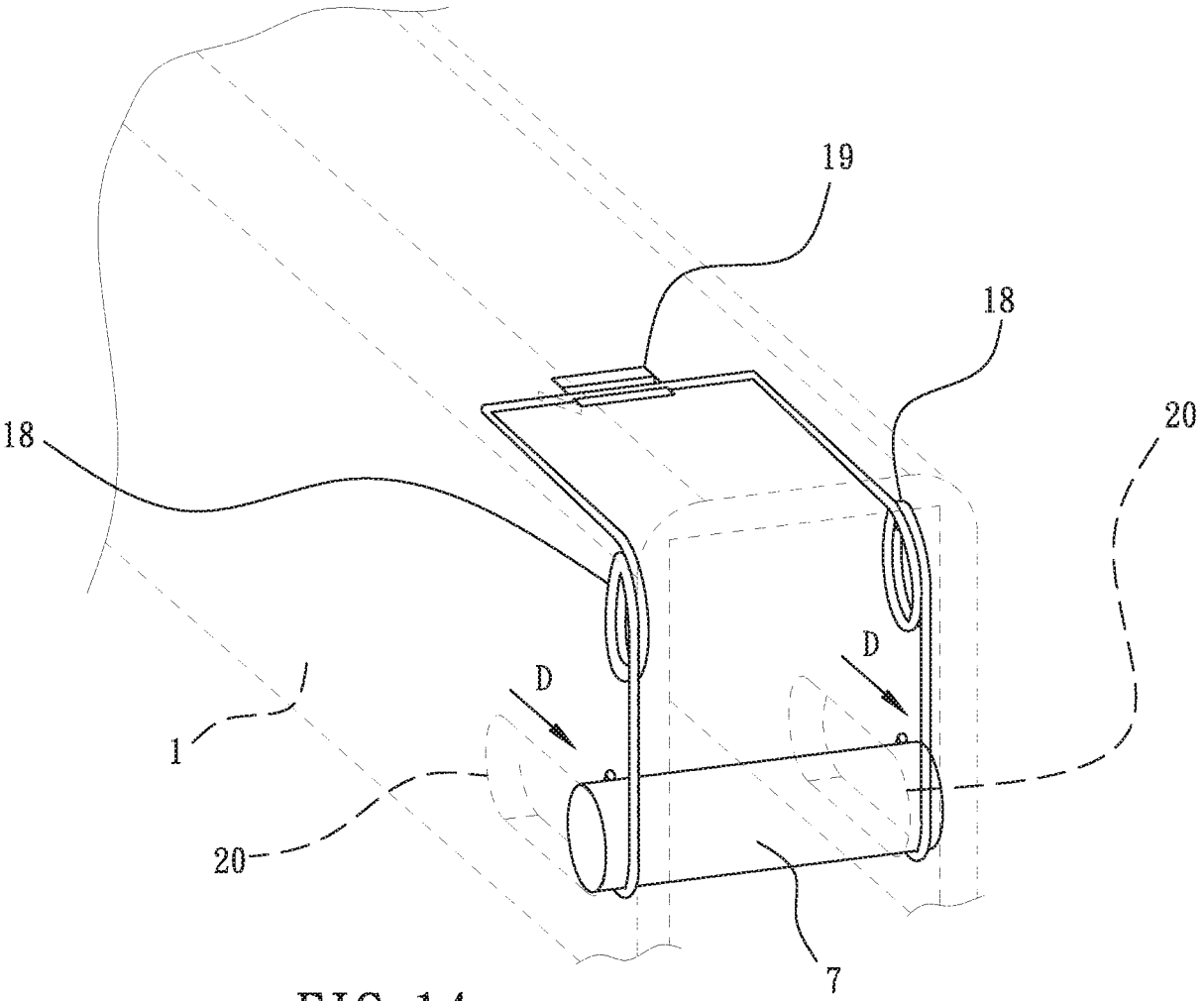
FIG. 14 is a schematic drawing showing a return spring disposed on a positioning portion of an embodiment according to the present invention.
Figure 15:
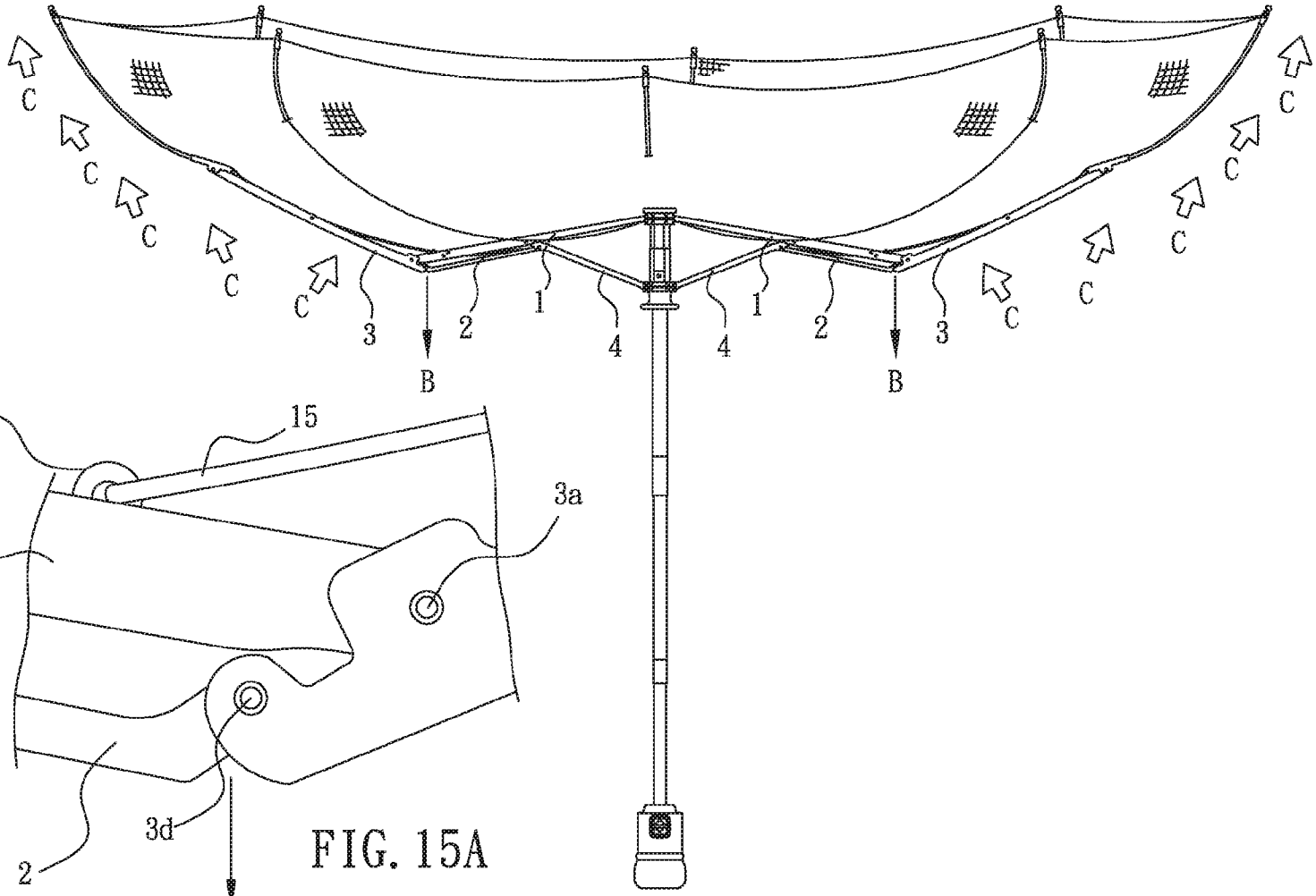
FIG. 15 is a schematic drawing showing a conventional umbrella whose inside is turned out during a sudden wind gust.
Figure 15A:
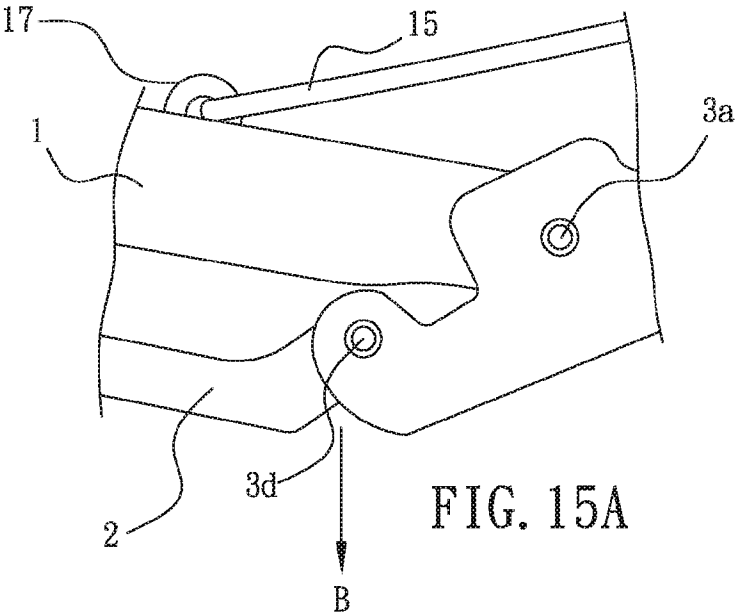
FIG. 15A is a partial enlarged view of the embodiment in FIG. 15 according to the present invention.

In addition, the positioning portion 7 can be designed into a movable positioning portion 7, as shown in FIG. 14. Two side walls of the inner main rib 1 are disposed with a long slot 20 respectively by machining for mounting the movable cylindrical positioning portion 7 (such as a rivet). A return spring 18, such as a line-type return spring 18 shown in FIG. 14, is disposed on the movable positioning portion 7. The return spring 18 is fixed on a positioning point 19 in the inner main rib 1. The fixing way of the return spring 18 is not limited. The return spring 18 has a preset opening angle while being formed. When the opening angle is compressed, a reaction force is generated by the return spring 18 and used as a return force of the positioning portion 7, as the arrow D in FIG. 14 indicates. Thus the positioning portion 7 can be adjusted elastically relative to the locking portion 8 (8*a*) during the locking process of the locking portion 8 (8*a*) with the positioning portion 7. Thereby the reliability in opening and closing of the umbrella is improved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An anti-turning umbrella frame comprising a plurality of inner main ribs each of which having an inner end connected to a notch of a shaft, a plurality of middle main ribs, and a plurality of stretchers each of which having an inner end connected to a runner of the shaft;

a plurality of inner connecting ribs each of which is arranged between a part of the stretcher close to the outer end of the stretcher and an inner end of the middle main rib;

a first rivet point formed by an outer end of the inner main rib being riveted to an inner end of the middle main rib;

a second rivet point formed by an outer end of the stretcher being riveted to a middle part of the inner main rib;

a third rivet point formed by an inner end of the inner connecting rib being riveted to a part of the stretcher close to the outer end of the stretcher;

a fourth rivet point formed by an outer end of the inner connecting rib being riveted to an inner end of the middle main rib;

wherein the fourth rivet point is located on an inner side of the first rivet point when the umbrella frame is opened; wherein a positioning portion is disposed on an inner side of the first rivet point of the inner main rib while a locking portion is arranged at the inner connecting rib; the locking portion is corresponding to and matched with the positioning portion; the locking portion and the positioning portion are locked with each other synchronously while the umbrella frame is opened; thus the inner main rib and the middle main rib are connected to form a rigid body for preventing the fourth rivet point from rotating around or pivoting downward with respect to the first rivet point; thereby the middle main rib will not be turned over with respect to the inner main rib.

2. The device as claimed in claim 1, wherein the locking portion is set on an outer end of the inner connecting rib.

3. The device as claimed in claim 1, wherein the locking portion is arranged at the inner connecting rib and located close to an outer end of the inner connecting rib; there is a distance between the locking portion and the outer end of the inner connecting rib.

4. The device as claimed in claim 1, wherein the positioning portion is a rivet disposed on the inner main rib while the locking portion is a positioning hook or a positioning slot arranged at the inner connecting rib.

5. The device as claimed in claim 1, wherein a structure of the inner connecting rib is selected from the group consisting of one plate integrally formed, two plates attached to each other at two ends thereof with a gap at a middle part therebetween, one round rod integrally formed, and two plates attached to each other at two ends thereof with a gap at a middle part therebetween and having one plate connected to an outer end of the two plates.

6. The device as claimed in claim 1, wherein the positioning portion is located on an inner side of the first rivet point and there is a certain distance between the positioning portion and the first rivet point.

7. The device as claimed in claim 1, wherein a cross section of the positioning portion is round, oval or oblong.

8. The device as claimed in claim 1, wherein an oblong rivet hole is arranged at the fourth rivet point where the inner connecting rib is riveted to the middle main rib; the oblong rivet hole is located on an outer side of the locking portion.

9. The device as claimed in claim 1, wherein the positioning portion is a movable positioning portion disposed on the inner main rib while two side walls of the inner main rib are disposed with a long slot for mounting the movable positioning portion; a return spring is disposed on the movable positioning portion and used for allowing the movable positioning portion able to be adjusted elastically relative to the locking portion during a locking process of the locking portion with the positioning portion.

10. The device as claimed in claim 1, wherein the anti-turning umbrella frame is applied to a foldable umbrella selected from the group consisting of an automatic open/close umbrella, an automatic open umbrella, an automatic close umbrella, and a manual umbrella.

* * * * *